US010415192B2

(12) United States Patent
Wijers

(10) Patent No.: US 10,415,192 B2
(45) Date of Patent: Sep. 17, 2019

(54) ARTIFICIAL TURF SYSTEM WITH FORCED AIRFLOW

(71) Applicant: Ten Cate Thiolon B.V., Nijverdal (NL)

(72) Inventor: Bart Wijers, Nijverdal (NL)

(73) Assignee: Ten Cate Thiolon B.V., Nijverdal (NL)

( * ) Notice: Subject to any disclaimer, the term of this patent is extended or adjusted under 35 U.S.C. 154(b) by 0 days.

(21) Appl. No.: 15/764,331

(22) PCT Filed: Sep. 30, 2016

(86) PCT No.: PCT/NL2016/050674
§ 371 (c)(1),
(2) Date: Mar. 29, 2018

(87) PCT Pub. No.: WO2017/058018
PCT Pub. Date: Apr. 6, 2017

(65) Prior Publication Data

US 2018/0282950 A1 Oct. 4, 2018

(30) Foreign Application Priority Data

Oct. 2, 2015 (NL) ..... 2015543

(51) Int. Cl.
*E01C 13/02* (2006.01)
*E01C 13/08* (2006.01)
*A63C 19/00* (2006.01)

(52) U.S. Cl.
CPC ..... *E01C 13/02* (2013.01); *E01C 13/08* (2013.01)

(58) Field of Classification Search
CPC ..... E01C 13/00; E01C 13/02; E01C 13/08; E01C 13/045; E01C 13/083; A63C 19/00; A63C 19/04; A63J 3/00
(Continued)

(56) References Cited

U.S. PATENT DOCUMENTS 5,254,039 A 10/1993 Garcia
8,133,123 B2 * 3/2012 De Vries ..... E01C 13/02 472/92
(Continued)

FOREIGN PATENT DOCUMENTS

JP 05132909 A 5/1993
WO 03/035984 A1 5/2003
(Continued)

OTHER PUBLICATIONS

Dutch Search Report of NL2015543 dated May 12, 2016.
International Search Report of PCT/NL2016/050674 dated Dec. 21, 2016.

*Primary Examiner* — Kien T Nguyen
(74) *Attorney, Agent, or Firm* — N.V. Nederlandsch Octrooibureau; Catherine A. Shultz; Tamara C. Stegmann

(57) ABSTRACT

An artificial turf system defining a playing area comprises an artificial turf layer with an air distribution layer located beneath the turf layer, by which air can be distributed throughout the playing area. The air distribution layer is closed at edge regions to define a periphery of the playing area and an air supply is in fluid communication with the air distribution layer to provide a flow of air. A flow regulating layer is located between the air distribution layer and the turf layer, the flow regulating layer being provided with a plurality of openings arranged to allow permeation of air through the turf layer within the playing area. The proposed system allows air to be distributed uniformly over the whole of the playing area for cooling of the turf layer.

20 Claims, 4 Drawing Sheets

(58) Field of Classification Search
USPC ..... 472/88–92, 94; 428/221, 36, 39, 46
See application file for complete search history.

(56) References Cited

U.S. PATENT DOCUMENTS

| | | | |
|---|---|---|---|
| 2003/0082359 | A1 | 5/2003 | Scott |
| 2010/0203265 | A1 | 8/2010 | Tetrault |
| 2015/0259863 | A1 | 9/2015 | Van Raam et al. |

FOREIGN PATENT DOCUMENTS

| | | | |
|---|---|---|---|
| WO | 2007/061289 | A1 | 5/2007 |
| WO | 2014/092577 | A1 | 6/2014 |

* cited by examiner

ARTIFICIAL TURF SYSTEM WITH FORCED AIRFLOW

BACKGROUND OF THE INVENTION

1. Field of the Invention

The present invention relates to artificial turf systems and in particular to systems in which the temperature of the artificial turf within a playing area may be cooled or heated by forced air flow. The invention also relates to the operation of such a system in order to achieve a desired cooling or heating effect for a playing area.

2. Description of the Related Art

Artificial turf systems are well known in the art. Such systems may comprise a backing layer such as a woven fabric in which artificial grass fibers are tufted to form a pile.

The fibers may be fixed to the backing layer using latex or polyurethane to ensure adequate pull-out resistance. On the upper surface of the backing layer, an infill layer of soft granules, sand or the like may be disposed between the fibers. The backing layer and the fibers can also be produced simultaneously by weaving the backing and the pile in a single process. In such a weaving process there may be more design freedom for the positioning of the fibers and for the structure of the backing.

The infill layer can provide the necessary sports performance in terms of force reduction, vertical ball bounce and rotational friction. This can be further supplemented by application of a shock pad or e-layer directly under the backing layer.

Due to an absence of water in the artificial turf structure, in hot areas of the world with high solar radiation, the temperature of the fibers can reach up to 70° C. In those cases where black rubber granules are applied as infill, the surface temperature can even rise close to 100° C. Field temperatures over 50° C. are experienced by players to be unpleasant or uncomfortable. Hot surface temperatures are even a health risk, since feet become too hot and blisters or other skin damage can occur. Besides that a hot surface is very uncomfortable, and in some cases, bad smells may be released.

Numerous technologies are available that attempt to decrease the surface temperature of an artificial turf system using components that reflect solar radiation. The effect is however very limited because effective reflection of sunlight from an artificial turf pitch is limited. As a result, a major part of the solar radiation—more specifically the near infrared portion—is absorbed by the fibers and the infill material. This radiation is transferred into heat in the absorbing material/component. Once the material becomes heated, subsequent release of the heat by conduction or radiation is limited. One way in which this may be achieved is by evaporation from the surface of the component to be cooled, using water as a cooling agent. Evaporation of water is well known as a very effective method of cooling. Nevertheless, a supply of fresh water is required. It must also be clean to prevent smell and bacterial growth in the artificial turf system. This is a problem because of the shortage of clean, fresh water, especially in the hottest areas of the world, which are just the areas where artificial turf can offer a solution to gain a consistent green sport surface.

One system that proposes a method of cooling an artificial turf system is described in JP05-132909. The system comprises water collecting and draining air supply tubes buried vertically and horizontally in the ground. Although the system appears to alleviate at least partially some of the problems of overheating of artificial turf, it would be desirable to provide an alternative structure that provided more uniform air distribution. Another system is known from US 2003/0082359 that proposes a method to control the subterranean environment of a variety of media, including artificial and natural turf surfaces in sports stadiums, gardens, botanical displays, roof-top gardens, and lawns. The system uses modular elements that can allow a fluid to circulate beneath the media.

BRIEF SUMMARY OF THE INVENTION

According to the invention there is provided an artificial turf system defining a playing area, the system comprising: an artificial turf layer; an air distribution layer beneath the turf layer, by which air can be distributed throughout the playing area, the air distribution layer being closed at edge regions defining a periphery of the playing area; an air supply in fluid communication with the air distribution layer; and a flow regulating layer between the air distribution layer and the turf layer, the flow regulating layer being provided with a plurality of openings arranged to allow permeation of air through the turf layer within the playing area. The proposed system allows air to be distributed uniformly over the whole of the playing area for cooling of the turf layer.

The air distribution layer may take various forms and will be at least partially dependent on the sport to be performed. In one embodiment, this layer comprises a rigid, open construction. In this context, "rigid" is intended to refer to the fact that the air distribution layer is strong and stiff enough to cope with the forces and pressure that can be released on the field (e.g., players, maintenance machines, events). The layer may also have some elastic performance to contribute to the sport characteristics of the turf system. It may be positioned on an otherwise solid or rigid substrate, such as packed earth, concrete, sand, asphalt, or the like. The substrate beneath the air distribution layer may be impervious or otherwise resist the escape of air downwards. It must be watertight, whereby any water falling onto the playing area and entering the air distribution layer can be collected. The term "open" is intended to refer to the fact that the layer has more void than material i.e. more than 50% of interconnected void. It will be understood that the amount of void and the ease with which air may be distributed beneath the turf layer, will determine the uniformity of flow through the turf layer. In some cases, there may be more than 70% void or even, more than 80% void. Both pre-fabricated layers and in-situ constructions may be used, including open stone layers through which air can be transported.

In one embodiment a plastic crate type structure may be used. Such crates have already been implemented as a base for sports surfaces, since they may be assembled in a modular structure and are easy to transport and assemble. One such crate system is available as Permavoid 85 from Permavoid Ltd, comprising 85 mm high polypropylene elements having a volumetric void ratio of 92%. It will be understood that other similar spatial constructions may be used to achieve the same effect.

Additionally or alternatively, the air distribution layer may comprise an open, resilient layer. In this context, resilient is intended to refer to the fact that this layer contributes specifically to the sport performance characteristics of the playing area. An important requirement of many artificial turf systems is that the sport functional performance still fulfils the specific requirements for the given sport (e.g., FIFA Quality Concept requirements). The air distribution layer may comprise spring or damper-like elements with voids there between, whereby the energy restitution and shock absorption requirements of the playing area may be combined with the air distribution function.

The skilled person will however understand that these performance characteristics are never wholly attributable to a single layer and in the present context it may be considered that the air distribution layer plays a primary role in defining these characteristics. In one particular form, a resilient layer in the form of woven foam strips may be used, where the strips form upstanding loops with spaces therethrough. A product of this type, known as SINE™ is available from TenCate and described in WO2014/092577. Other foamed shock pads can be applied such as those consisting of cross-linked polyolefin material that may be foamed to a density of 30 to 250 kg/m3.

Since these foams have a closed cell structure, cuts may have to be made to let the air through the pad. Also shock pads based on open cell (e.g., polyurethane foam) or drain layers which consist of two geotextile support layers, separated from each other by sintered polymer fibers could be suitable for this application. The latter is known in the market as a polyfelt drain layer. Such shock pads may be used either as an air distribution layer or as a resilient layer or as flow regulating layer. Furthermore, such layers may be installed on the ground, with a layer of 5-20 cm of compacted crushed stone or lava stone on top, through which the air could be distributed. One system showing such a set-up is described in WO2007/061289.

In order to ensure adequate air transport and also reduce pressure variation across the playing area, the air distribution layer may have a height of between 0.5 cm and 50 cm, preferably between 5 cm and 20 cm. It will be understood that the actual height may depend at least partially on the void ratio, on the volume of air that it is intended to distribute, on the permeability of the flow regulating layer and also on the overall area of the playing area. For a high void ratio, less height may be required compared to a less open structure. In the case of a higher permeability of flow regulating layer, a greater height of air distribution layer may be required. A greater height may also be required in the case of a large playing area.

The flow regulating layer has the primary function of determining the rate of permeation of the air through the turf layer. The skilled person will understand that the actual rate of permeation of air through the turf layer is determined by a number of factors, including the cross-section of the air distribution layer and the structure of the turf layer itself. In general, flow through the air distribution layer will be primarily horizontal, whereas flow through the flow regulating layer will be primarily vertical.

Nevertheless, each may have a component of flow in a direction perpendicular to the primary direction. The flow regulating layer may be a separate layer between the air distribution layer and the turf layer, in which rate controlling openings are provided. The flow regulating layer may also be an integral part of the turf layer or alternatively may be integral with the air distribution layer. In one embodiment, the flow regulating layer may comprise a backing layer to which artificial grass fibres are attached to form the turf layer, e.g. by weaving or by tufting. When tufting, extra holes could be easily formed or punched for the openings. The flow regulating layer may also comprise a resilient layer, such as a porous foam layer, an in-fill layer or the like.

In another embodiment, the flow regulating layer may be a sheet of, e.g., plastic material provided with holes. In a further embodiment, the flow regulating layer may be a woven layer, either woven separately or together with the turf layer. The openings may be provided between the yarns of the weave, either by use of a suitably open weave or by varying the weave to leave openings.

As indicated above, the size of the openings in the flow regulating layer will be a primary determinant of the flow through the turf layer. Most artificial turfs are made of a backing layer in which fibers are tufted. A secondary backing of a latex, polyurethane or other dispersion coating is used to fix or hold the fibers into the primary backing layer to avoid fibre pull-out. To ensure drainage capacity to release water from the artificial turf layer, drainage holes of 3 to 6 mm diameter are punched into the backing with a typical spacing of 10 to 15 cm from each other. It has been found that this spacing of drainage holes is too large for use in cooling down the artificial turf because the airflow cannot disperse sufficiently through the turf layer. According to one embodiment of the present invention, the openings may be between 0.5 mm and 7 mm in size, preferably between 1 mm and 3 mm in size and more preferably between 1 mm and 2 mm in size. The openings may be of any shape, regular or irregular and including round, triangular, square, rectangular or the like. The size of the openings may be defined as the largest dimension of an individual opening.

The number and spacing of the openings in the flow regulating layer will be a further overall determinant of the flow through the turf. In one embodiment, the openings are spaced from each other by less than 50 mm, preferably by less than 30 mm and more preferably by less than 20 mm but more than 10 mm. In some embodiments, flow could be uniform and well distributed with a number of holes fairly evenly distributed. This can automatically spread the airflow equally with a certain pressure drop. For ease of production and installation, the size and spacing of the openings is preferably uniform over the whole of the playing area. Nevertheless, it is not excluded that there may be a variation in the openings e.g. in order to compensate for pressure variations across the playing area.

In order for a flow of air to be created in the air distribution layer, the air supply may comprise a form of closed connection or manifold that allows the air distribution layer to be in fluid communication with a source of air. There may be a single connection for the whole of the playing area or there may be a plurality of connections around the periphery. In one embodiment, the air supply may comprise one or more blowers and ducting to connect the one or more blowers to the air distribution layer.

In many cases, it will be desirable to supply air to the air distribution layer, which then exits the turf system upwards through the turf layer. Nevertheless, there may be situations where flow in the opposite direction is preferable. The one or more blowers may be reversible to allow air flow both downwards through the openings to the air distribution layer and vice versa.

It has been found that artificial turf systems that are under extreme solar radiation at high outdoor temperatures can be cooled down by flowing air at surrounding temperature through the system to reach acceptable levels under 50° C. This is because heat transfer is highly dependent on the difference in temperature between the material and the surrounding. If the direct surrounding is constantly refreshed by a forced airflow, the difference in temperature between the hot turf layer and the airflow is constantly at a maximum, leading to higher heat transfer from the surface and a temperature closer to the surrounding air temperature. Furthermore, if the air that is supplied is cooled beneath ambient temperature, it is possible to condensate water on the infill and artificial turf fibres, which can lead to extra cooling and better sliding performance. In many cases, the supply of air to the air distribution layer will itself suffice in providing the necessary cooling to the turf layer. This may at least partially be supplemented by adding moisture to the turf layer to encourage evaporative cooling.

Additionally, the air supply may comprise a cooling arrangement to cool the air prior to entry into the air distribution layer. This may be in the form of an air conditioner type unit, an evaporative cooling unit or any other device capable of reducing the air temperature.

In general, the problem described and discussed above is one of keeping a playing area cool under conditions of high solar radiation. According to another aspect of the invention, the system may also be used for heating of the turf layer should this be required. In regions where the temperature can be below zero for a significant portion of the year, heating system are sometimes installed under the artificial turf structure in order to prevent the artificial turf structure from freezing. Such heating systems generally consist of conventional water piping systems which may be switched on in October to run to the end of the winter period in order to prevent freezing. During a winter season considerable heat is lost by such a system. Electrical wired systems have also been introduced that are switched on only in periods below zero degrees or even only around the days that the pitch has to be used. These systems are more energy efficient but still use considerable energy. A further problem arises due to the increased use of shock pads beneath the turf that are heat insulating. As a result, heat coming from below the shock pad is hindered from arriving at the turf layer. According to the present invention, by providing the air supply with a heating arrangement, the air delivered to the air distribution layer can be heated.

Also, it is found that a frozen artificial turf structure can be heated by flowing heated air through the open construction under the turf structure. For example, air that is heated up to +10° C. can enter the open construction. The heat from below the artificial turf system can flow into the frozen artificial turf system. As the air in the distribution layer is refreshed constantly, the frozen artificial turf structure will melt in time. The water from molten ice and/or snow can be collected in the open construction and transported away from the field for functional usage.

The playing area may be a single region in terms of the air distribution, whereby the air distribution layer extends uninterrupted over the whole playing area. This may be suitable for relatively small playing areas but for larger areas such as for a full sized football pitch, it may be preferable to divide the playing areas into zones or regions that are individually supplied with air. It will be understood that each zone may in itself be considered a playing area. In one embodiment, the air distribution layer is divided into a plurality of separate regions within the playing area and ducting may be provided to connect the separate regions, each, respectively to its own fan, blower or source of air.

According to one embodiment, the air distribution layer may be closed around the periphery of the playing area by a curb. In order to prevent air leaking between the curb and the flow regulating layer, the flow regulating layer may be sealed to the curb by appropriate provisions such as tape or the like.

Temperature and airflow control can be arranged by temperature sensors in the field or by infra-red camera systems that monitors the surface temperature and controls the air volume and temperature thereof which is send to the corresponding zones of the field.

The invention also relates to a method of active cooling of a playing area in an artificial turf system, the method comprising: providing an air distribution layer, by which air can be distributed throughout the playing area, the air distribution layer being closed at edge regions defining a periphery of the playing area; providing a flow regulating layer over the air distribution layer, the flow regulating layer being provided with a plurality of openings arranged to allow passage of air; providing a turf layer over the flow regulating layer; connecting an air supply in fluid communication with the air distribution layer; and operating the air supply to cause air to flow through the air distribution layer and through the openings to cool the playing area.

The amount of air flow may be calculated according to the cooling effect required. In general the air supply may be operated to cause a flow outwards through the openings at an average rate over the playing area of between 0.001 m/s and 0.5 m/s, preferably between 0.05 m/s and 0.25 m/s and more preferably between 0.01 m/s and 0.1 m/s.

Alternatively, the air supply may be operated to cause a flow inwards through the openings at an average rate over the playing area of between 0.001 m/s and 0.5 m/s, preferably between 0.05 m/s and 0.25 m/s and more preferably between 0.01 m/s and 0.1 m/s. The above values are average values over the relevant surface and represent cubic meters per second of air flow per square meter of surface area.

The method may also comprise maintaining an overpressure within the air distribution layer, with respect to atmospheric pressure, of between 0.01 and 5 bar, more preferably between 0.05 and 1 bar. By having a relatively large volume within the air distribution layer compared to the volumetric flow through the turf layer, a relatively uniform overpressure throughout the playing area can be maintained.

The invention still further relates to an air distribution arrangement for an air permeable artificial turf layer, the air distribution arrangement comprising an air distribution layer forming a volume delimited at an upper side by the artificial turf layer and an air supply for creating an overpressure within the volume, such that air can escape from the volume through the artificial turf layer to cause cooling thereof.

The air distribution layer may be as described above or hereinafter and may be closed at edge regions to define a periphery of a playing area. Still further the air supply may also be as defined above or hereinafter and may comprise ducting connected to the air distribution layer at edge regions thereof, for connection to appropriate blowers or similar providers of a flow of air.

BRIEF DESCRIPTION OF THE DRAWINGS

The features and advantages of the invention will be appreciated upon reference to the following drawings of a number of exemplary embodiments, in which.

DESCRIPTION OF ILLUSTRATIVE EMBODIMENTS

Figure 1:
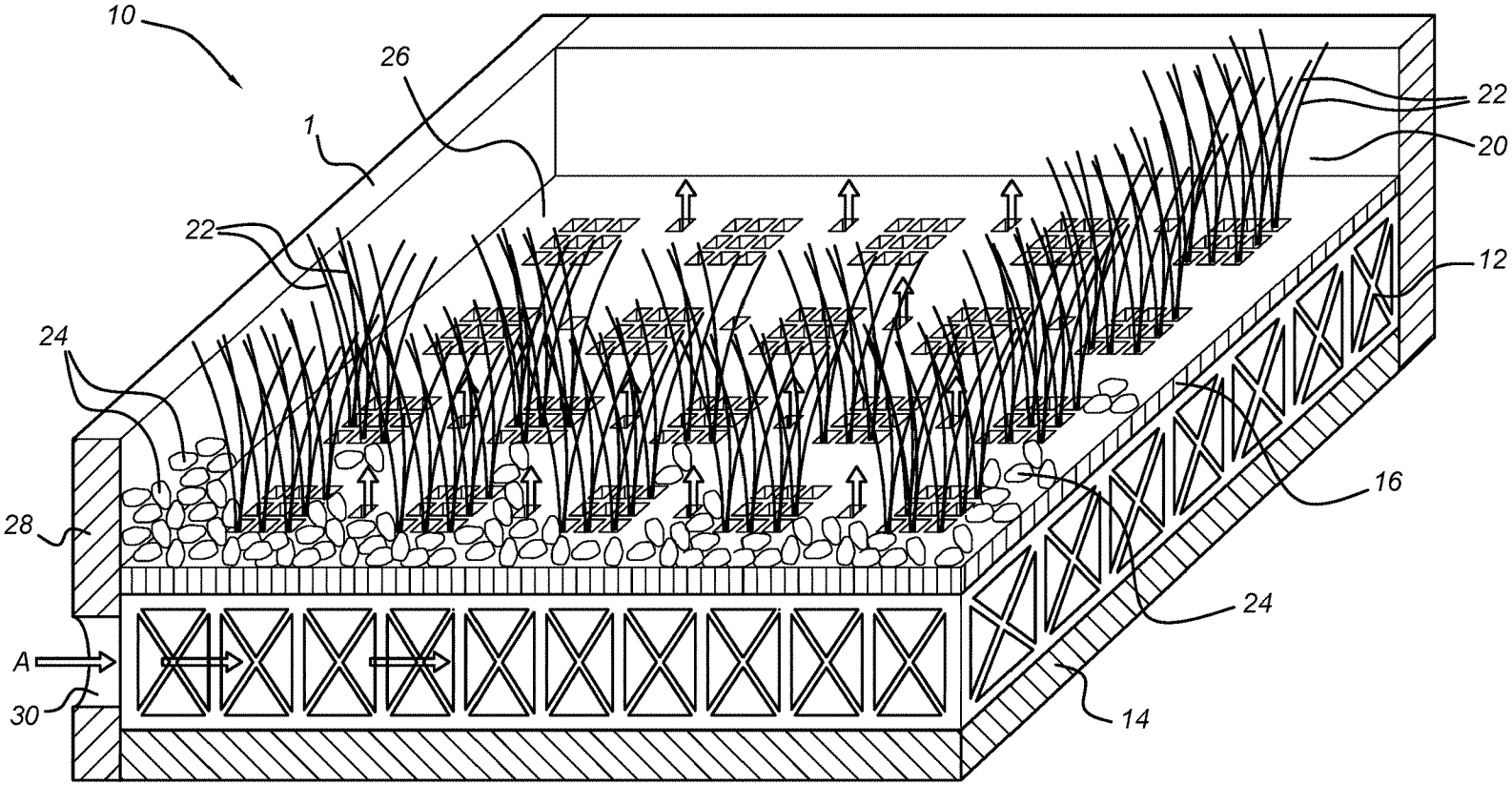
FIG. 1 shows a perspective view of a turf system according to a first embodiment of the present invention.

FIG. 1 shows a perspective view of an artificial turf system 10 according to a first embodiment of the invention.

The turf system 10 defines a playing area 1, of which only a portion is shown in FIG. 1. The turf system 10 comprises an air distribution layer 12, which in this embodiment is formed of Permavoid 85 panels as described above, laid onto a stabilised soil sub-base 14.

Above the air distribution layer 12, there is provided a flow regulating layer 16. The flow regulating layer 16 is a woven backing layer [e.g., polyester, pp, glassfibre] provided with a pattern of openings 18 to be further described below. An artificial turf layer 20 comprising upstanding artificial grass fibres 22 is woven together with the flow regulating layer 16. The artificial turf layer 20 also includes infill 24 distributed between the grass fibres 22 over the flow regulating layer 16. The infill 24 in this embodiment comprises conventional rubber granules or other infill materials like TPE, thermoplastic with a minimum particle size that is bigger than the airflow openings in the backing layer of the artificial turf. A skilled person will recognise that other infill material can be used as appropriate. The air distribution layer 12 is closed at an edge region 26 by a curb 28. The curb 28 includes ducts 30 in fluid communication with the air distribution layer 12 for air supply to the air distribution layer 12.

Figure 2:
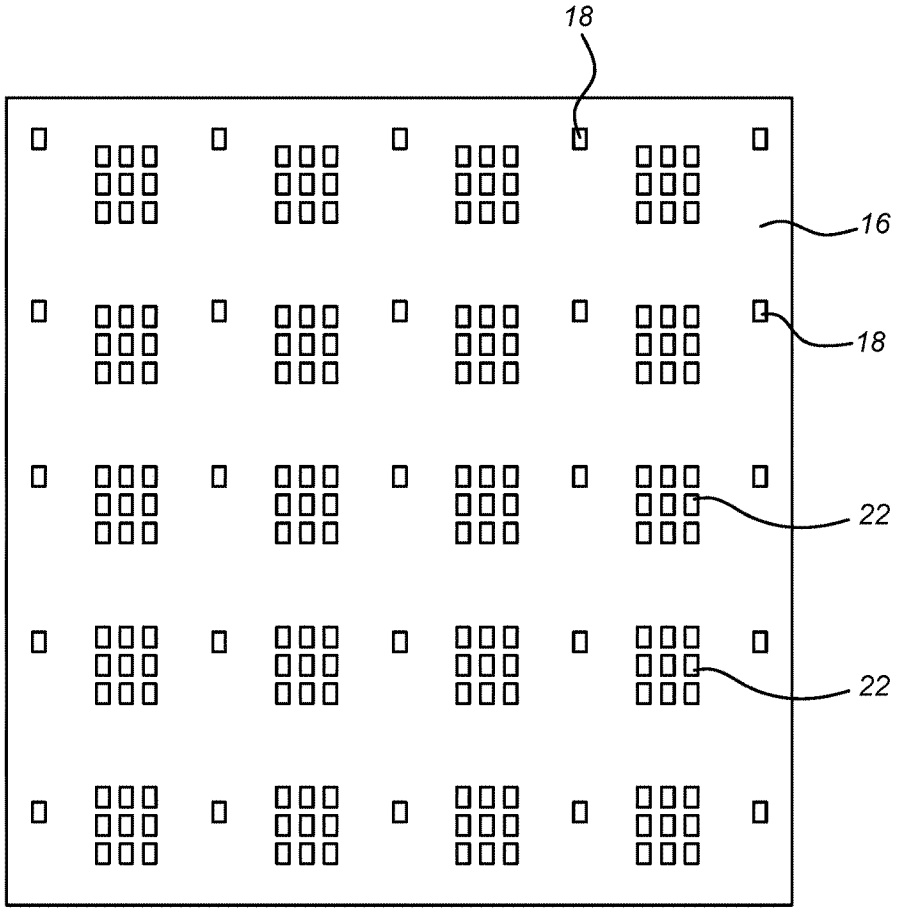
FIG. 2 shows a plan view of the flow regulating layer forming part of FIG. 1.

FIG. 2 shows a plan view of the flow regulating layer 16, indicating the openings 18 and the grass fibres 22. The openings 18 in this embodiment are square, with sides of 2 mm, being formed by the weave and being spaced on a regular spacing of 20 mm in both the warp and weft direction. The skilled person will understand that other dimensions and spacings can be applied as required. The grass fibres 22 are also spaced in a regular pattern, corresponding to the weave.

Figure 3:
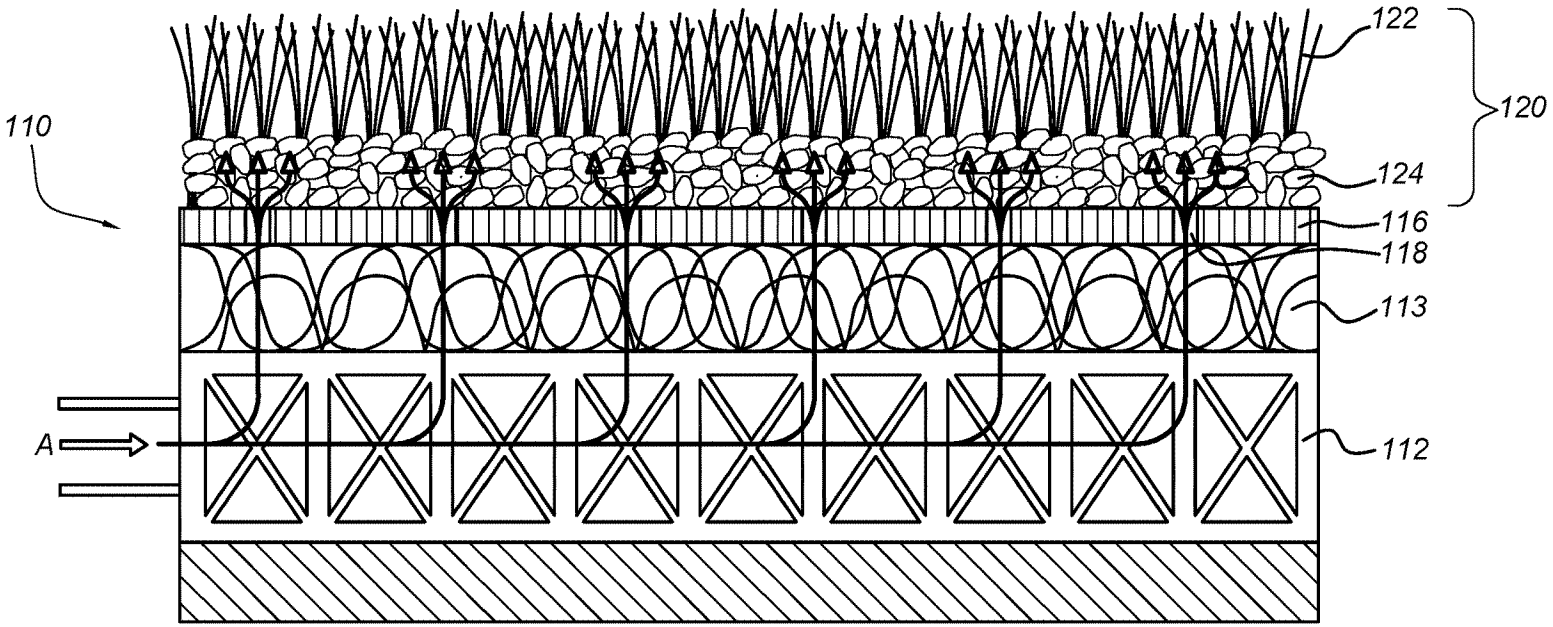
FIG. 3 shows a perspective view of a playing area including the turf system of FIG. 1.

FIG. 3 shows a perspective view of a playing area 1 in which the artificial turf system 10 of FIG. 1 is installed. Four blowers 34 are shown at four corners of the playing area 1. The blowers 34 are connected via manifolds 36 to the ducts 30 shown in FIG. 1.

Operation of the system 10 according to the invention will now be described with reference to FIGS. 1 to 3. Air A is supplied to the air distribution layer 12, through ducts 30 and manifolds 36 from blowers 34. The open nature of the air distribution layer 12 (having around 92% void ratio) means that the air can be quickly distributed throughout the playing area 1 beneath the flow regulating layer 16, leading to a substantially constant pressure regime within this volume. Due to the over-pressure beneath the flow regulating layer 16, air is forced outwards through the openings 18 over the whole of the playing area 1. In the event that the artificial turf layer 20 is warmer than the air, heat transfer to the air will occur, causing the turf layer 20 to be cooled. For a full sized football pitch of 8000 m2, the following air flows according to Table 1, may be calculated based on different opening sizes and spacings.

Table 1

Figure 4:
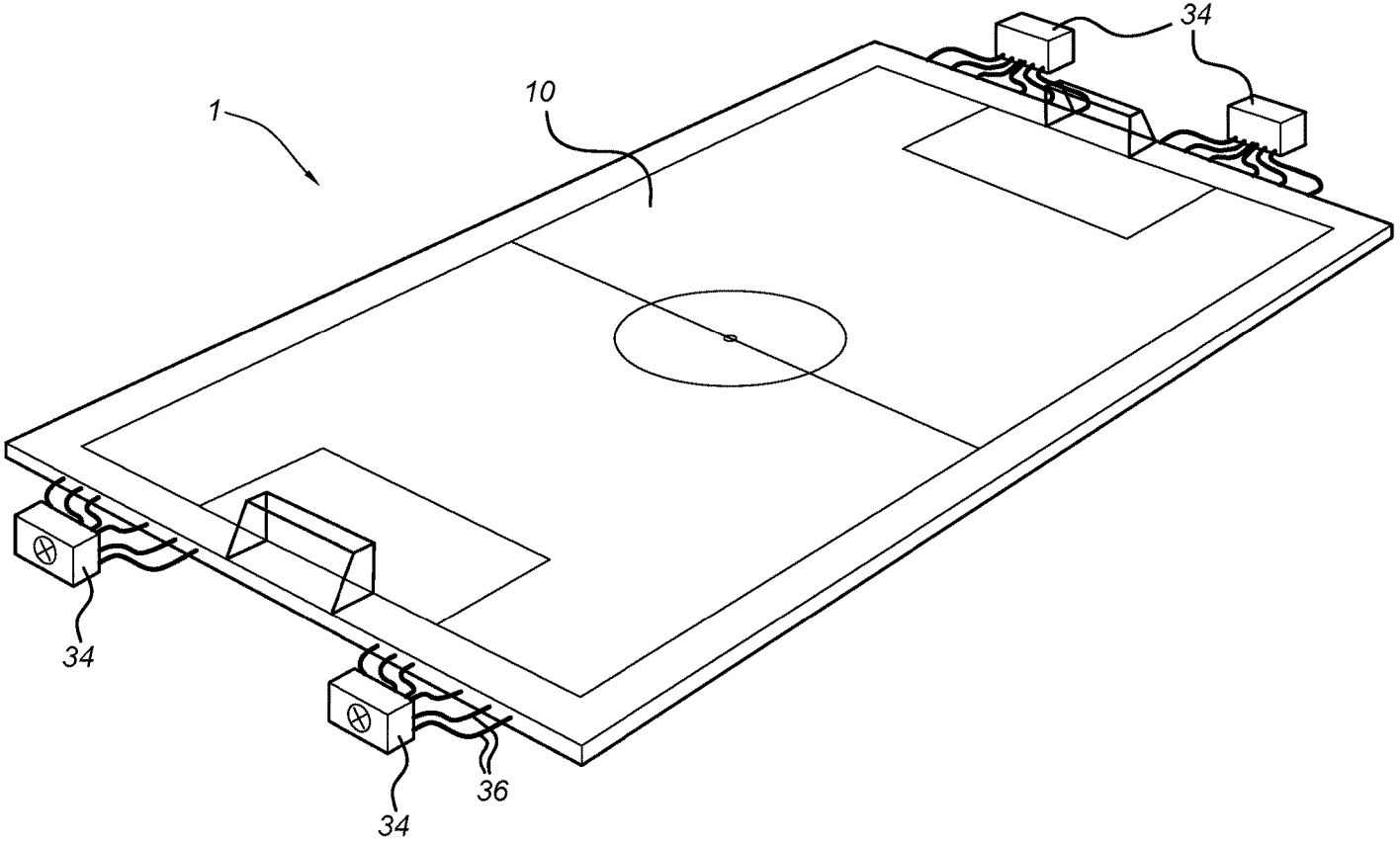
FIG. 4 shows a second embodiment of the invention in cross-section.

FIG. 4 shows in cross-section an alternative artificial turf system 110 according to a second embodiment of the invention in cross-section. In this embodiment, like features to the first embodiment are provided with the same reference preceded by 100.

According to FIG. 4, the turf system 110 comprises an air distribution layer 112, similar to that of FIG. 1. Supported upon the air distribution layer is an open shock pad 113 formed of woven foamed material available under the name SINE™ from TenCate. The open shock pad 113 is sufficiently porous not to inhibit passage of air in an upward direction and may also participate in the horizontal distribution of air.

Above the shock pad 113, there is a flow regulating layer 116 having openings 118 and an artificial turf layer 120 comprising artificial grass fibres 122 and infill 124, which is otherwise identical to the first embodiment. Operation of the turf system of FIG. 4 is identical to that of FIGS. 1 to 3, with the added benefit of additional shock absorption capabilities due to the presence of the shock pad 113.

Thus, the invention has been described by reference to certain embodiments discussed above. It will be recognized that these embodiments are susceptible to various modifications and alternative forms well known to those of skill in the art. Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. An artificial turf system defining a playing area, the system comprising:

an artificial turf layer;

an air distribution layer beneath the turf layer, by which air can be distributed throughout the playing area, the air distribution layer being closed at edge regions defining a periphery of the playing area;

an air supply in fluid communication with the air distribution layer; and a flow regulating layer between the air distribution layer and the turf layer, wherein the flow regulating layer is a backing layer having artificial grass fibres directly attached thereto by weaving or tufting to form the turf layer and a plurality of openings being arranged through the backing layer to allow permeation of air through the turf layer within the playing area wherein the openings in the backing layer are between 0.5 mm and 7 mm in size and are spaced from each other by less than 50 mm but more than 5 mm.

2. The system according to claim 1, wherein the air distribution layer comprises a rigid, open construction.

3. The system according to claim 1, wherein the air distribution layer comprises a plastic crate type structure.

4. The system according to claim 1, wherein the air distribution layer comprises an open, resilient layer.

5. The system according to claim 1, wherein the air distribution layer has a height of between 0.5 cm and 50 cm, preferably between 4 cm and 20 cm.

6. The system according to claim 1, wherein the flow regulating layer is a backing layer in which the artificial grass fibres are woven to form the turf layer.

7. The system according to claim 1, wherein the openings in the flow regulating layer are between 1 mm and 3 mm in size and more preferably between 1 mm and 2 mm in size.

8. The system according to claim 1, wherein the openings in the flow regulating layer are spaced from each other by less than 30 mm and more preferably by less than 20 mm.

9. The system according to claim 1, wherein the flow regulating layer is a woven layer.

10. The system according to claim 1, wherein the flow regulating layer is a non-woven into which the artificial grass fibres are tufted.

11. The system according to claim 1, wherein the air supply comprises one or more blowers and ducting to connect the one or more blowers to the air distribution layer.

12. The system according to claim 11, wherein the one or more blowers is reversible to allow air flow both through the openings to the air distribution layer and vice versa.

13. The system according to claim 11, wherein the air distribution layer is divided into a plurality of separate regions within the playing area and the ducting connects to the separate regions.

14. The system according to claim 1, wherein the air supply comprises a heating arrangement.

15. The system according to claim 1, wherein the air supply comprises a cooling arrangement.

16. The system according to claim 1, wherein the air distribution layer is closed at its edge regions by a curb.

17. A method of active cooling of a playing area in an artificial turf system according to claim 1, the method comprising:

providing an air distribution layer, by which air can be distributed throughout the playing area, the air distribution layer being closed at edge regions defining a periphery of the playing area;

providing a flow regulating layer over the air distribution layer, the flow regulating layer being provided with a plurality of openings arranged to allow passage of air and having artificial grass fibres directly attached thereto by weaving or tufting to form an artificial turf layer;

connecting an air supply in fluid communication with the air distribution layer; and operating the air supply to cause air to flow through the air distribution layer and through the openings to cool the playing area.

18. The method of claim 17, comprising operating the air supply to cause a flow outwards through the openings at an average rate over the playing area of between 0.001 m/s and 0.5 m/s, preferably between 0.05 m/s and 0.25 m/s and more preferably between 0.01 m/s and 0.1 m/s.

19. The method of claim 17, comprising operating the air supply to cause a flow inwards through the openings at an average rate over the playing area of between 0.001 m/s and 0.5 m/s, preferably between 0.05 m/s and 0.25 m/s and more preferably between 0.01 m/s and 0.1 m/s.

20. The method of claim 17, comprising maintaining an overpressure within the air distribution layer, with respect to atmospheric pressure, of between 0.01 and 5 bar, more preferably between 0.05 and 1 bar.

* * * * *